United States Patent [19]

Gibson

[11] Patent Number: 4,856,387

[45] Date of Patent: Aug. 15, 1989

[54] HERMAPHRODITE WRENCH

[76] Inventor: Peter O. Gibson, 58 Forest Ave., Riverside, Ill. 60546

[21] Appl. No.: 300,204

[22] Filed: Jan. 23, 1989

Related U.S. Application Data

[63] Continuation of Ser. No. 36,386, Apr. 9, 1987, abandoned.

[51] Int. Cl.[4] ..... B25B 13/02

[52] U.S. Cl. ..... 81/124.4; 81/124.7; 81/437

[58] Field of Search ..... 81/124.4, 124.7, 177.1, 81/440, 450, 437, 439, 451, 436, 176.1, 124.3, 125.1, 461

[56] References Cited

U.S. PATENT DOCUMENTS 3,276,299 10/1966 Halburian ..... 81/124.4
4,291,425 9/1981 Sweitzer ..... 81/124.4

FOREIGN PATENT DOCUMENTS 364963 12/1922 Fed. Rep. of Germany ..... 81/437

*Primary Examiner*—Robert P. Olszewski
*Assistant Examiner*—Maurina Rachuba

[57] ABSTRACT

A wrench possessing a body situated at the juncture of two perpendicularly disposed handles each extending along a longitudinal axis lying within a fiducial plane is given. The body possesses a plurality of open cavities, each presenting a hexagonal aperture normal a central axis. Two blind cavities have central axes within the fiducial plane, opening opposite the handle side. One cavity is through the body, with a central axis normal the fiducial plane, has stepped walls and presents two opposed hexagonal apertures. Each aperture is of a different size. Each handle has one free end of hexagonal cross section normal the longitudinal axis of that handle. The two ends are of different size. A plurality of hexagonal engagements, both male and female, each affording full perimeter contact with a workpiece is thus enabled by a single tool.

5 Claims, 1 Drawing Sheet

FIG. 1
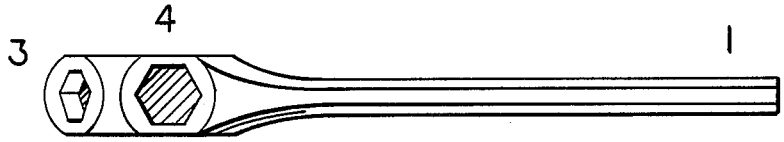
FIG. 2
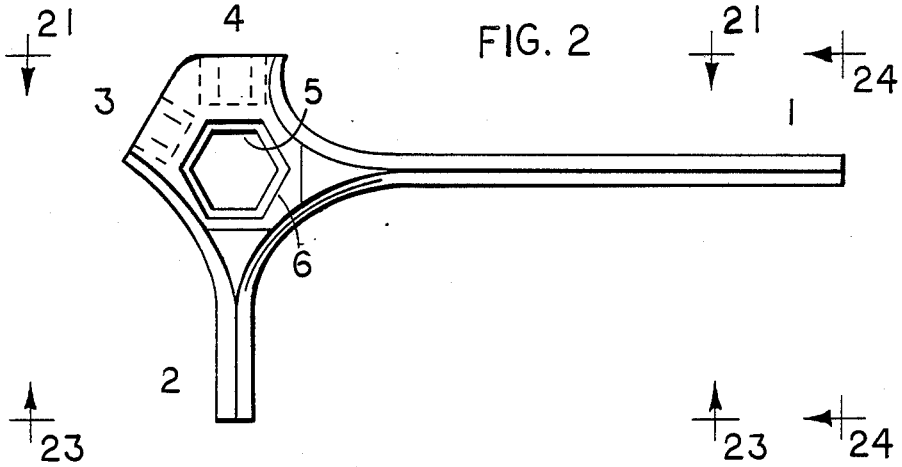
FIG. 3
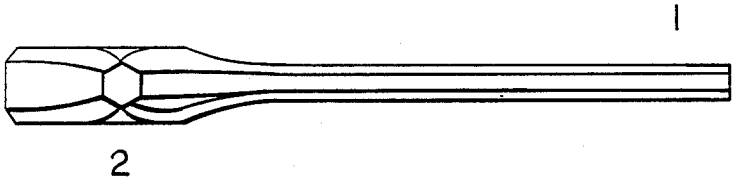
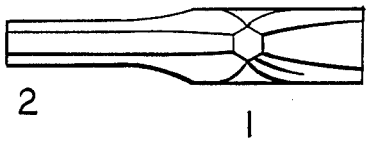
FIG. 4

HERMAPHRODITE WRENCH

This is a continuation of application Ser. No. 07/036,386, filed Apr. 9th, 1987 now abandoned.

BACKGROUND OF THE INVENTION

The maintenance of mobile equipment typically employs various wrenches, including both spanner, box or socket styles which engage externally and insertion drive types. Box and socket style wrenches, enabling full perimeter contact, provide a grip superior to that of open end wrenches, or spanners. Superior grip is also characteristic of hexagonal insertion drive type wrenches, or Allen keys, as opposed to flat blades. It is desirable to minimize the quantity and weight of wrenches required for servicing a given range of such engagements.

SUMMARY OF THE INVENTION

A single, integral wrench consisting of two opposed handles and a body at their junction is considered. The body possesses a plurality of cavities, each bounded by parallel walls defining a hexagonal aperture affording full perimeter contact. The free end of each handle has a hexagonal cross section for engagement via insertion. The opposition of said handles facilitates the transmission of torque via the end of one handle from force applied upon the other. Employment of the handles for direct drive via insertion as well as a means for the application of leverage to cavities permitting external, full perimeter contact enables a multitude of hexagonal engagements both male and female in one tool.

BRIEF DESCRIPTION OF THE DRAWINGS

FIG. 2 is a top elevational view representing a preferred embodiment of the current invention with the axes of both handles, 1 and 2, within the plane of the drawing, as are the axes of sockets 3 and 4. The common axis of boxes 5 and 6 is normal to said plane of the drawing.

FIG. 1 is a rear elevational view thereof, taken from line 21 in FIG. 2. The axis of socket 4 is normal to the plane of the drawing, that of socket 3 disposed at an angle to the same.

FIG. 3 is a front elevational view thereof, taken from line 23 in FIG. 2. The axis of handle 1 lies in the plane of the drawing, that of handle 2 is normal to the same.

FIG. 4 is an end elevational view therof, taken from line 24 in FIG. 2. The axis of handle 2 is within the plane of the drawing, that of handle 1 is normal to the same.

DETAILED DESCRIPTION OF THE INVENTION

A single, integral wrench, comprised of a body and two opposed operatively connected longitudinal extensions known as handles, is made of metal, preferably tool steel. Said body possesses a plurality of cavities. It is investment cast via lost wax process and hardened by heat treatment to obtain a sculptured form and the strength required of a hand tool. Said handles may be cast with the body or consist of lengths of bar stock attached to said body by a press fit, staking, cross pin, weld, brazing, threading or other means of fastening.

Said two handles must be opposed: disposed spatially with a substantial angle between their longitudinal axes.

The right angle given, as seen in FIG. 2, between handles 1 and 2, is exemplary of this relation as the exertion of torque requires the application of force in a direction perpendicular to the axis of rotation. The free end of each said handle is circumscribed by parallel exterior walls defining a hexagonal protrusion of length sufficient to enable secure engagement for the exertion of torque via insertion into a hexagonal cavity. The hexagonal end of handle 1 is shown in FIG. 4, that of handle 2 in FIG. 3. Each said hexagonal end is normal to its respective handle axis. Each said handle axis is coincident with its axis of engagement and said axis of rotation.

As seen in FIG. 2, the axis of the thru cavity in which box engagements 5 and 6 are formed hexagonal is normal to the plane defined by said axes of handles 1 and 2, exemplary of efficient arrangement for the transmission of torque. The coincidence of the two axes of said box engagements 5 and 6 is exemplary with regard to space, material and weight of the tool. Said boxes, 5 and 6, each constitute a hexagonal cavity, possessing six contiguous walls parallel to and equidistant from said axis of the cavity, which define a hexagonal aperture and the full perimeter said cavity. Sockets 3 and 4, clearly seen in FIG. 1, comprise blind hexagonal cavities formed in adjacent sides of the wrench body 7.

Said sockets 3 and 4 and said boxes 5 and 6 comprise hexagonal cavities which provide full perimeter contact in engagement, enabling the secure exertion of torque with application of force upon handle 1 or 2. The ends of said handles enable the secure exertion of torque via insertion into hexagonal cavities with force applied upon the other said opposed handle.

With understanding that the foregoing description is exemplary of the preferred embodiments of the principles relating to the present invention, I hereby claim to secure by Letters Patent:

1. A wrench comprising:

a body having two parallel faces; said body having a plurality of socket openings, each of said sockets having a central axis and a hexagonal cross-section; one of said sockets having a central axis which extends perpendicularly to the other central axes; said one of said sockets having a hexagonal cross-section which opens on both parallel faces of said body; and two handles; each handle having an end attached to said body; each of said handles having a longitudinal axis and a free end having a hexagonal cross-section, both of said handle axes lying in a plane parallel to said body faces, said handle axes disposed perpendicularly to each other.

2. A wrench in accordance with claim 1 wherein one of said socket central axes is disposed substantially within said plane.

3. A wrench in accordance with claim 2 wherein one of said socket central axes is disposed substantially perpendicular one said longitudinal handle axis and substantially axial other said longitudinal handle axis.

4. A wrench in accordance with claim 2 wherein one of said socket central axis is disposed at an obtuse angle with respect to both said longitudinal handle axes.

5. A wrench according to claim 1, wherein said perpendicular socket has stepped inner walls to present a different sized hexagonal opening on each of the parallel faces of said body.

* * * * *